United States Patent [19]

Coq

[11] 4,257,344

[45] Mar. 24, 1981

[54] DEVICE FOR DEPOSITING A LIQUID BINDER ON A FIBROUS SHEET FOR MANUFACTURING CIGARETTE FILTERS

[76] Inventor: Francois Coq, 1 rue Pierre Loti, 66000 Perpignan, France

[21] Appl. No.: 956,566

[22] Filed: Nov. 1, 1978

[30] Foreign Application Priority Data

Dec. 23, 1977 [FR] France ..... 77 38957

[51] Int. Cl.[3] ..... B05C 5/00; B05B 15/04

[52] U.S. Cl. ..... 118/301; 118/70; 118/325; 118/326

[58] Field of Search ..... 118/70, 301, 325, 326

[56] References Cited

U.S. PATENT DOCUMENTS

| | | | |
|---|---|---|---|
| 2,911,941 | 11/1959 | Sokal | 118/326 X |
| 3,036,551 | 5/1962 | Shreckhise | 118/326 X |
| 3,172,780 | 3/1965 | Csok et al. | 118/326 X |
| 3,226,773 | 1/1966 | Paliyenko | 118/325 X |
| 4,132,189 | 1/1979 | Greve et al. | 118/326 X |

FOREIGN PATENT DOCUMENTS

| | | |
|---|---|---|
| 434489 | 8/1935 | United Kingdom . |
| 505730 | 5/1939 | United Kingdom . |
| 925035 | 5/1963 | United Kingdom . |
| 1017576 | 1/1966 | United Kingdom . |
| 1430231 | 3/1976 | United Kingdom . |

*Primary Examiner*—Michael R. Lusignan
*Attorney, Agent, or Firm*—Michael F. Petock

[57] ABSTRACT

The device permits the application in the form of a mist on a sheet wholly or partly consisting of artificial or synthetic short fibres, such as cellulose acetate fibres, a liquid chemical agent for binding the fibres together, for example a specific plasticizer of the constituent material of the fibres. The sheet may be produced by a conventional paper-making method or a non-woven method and is intended for the production of cigarette filters. The device comprises a rotary support roller with which one face of the fibrous sheet is in contact in the zone of the spraying of the binding agent, the spraying being carried out on the other face of the sheet.

6 Claims, 2 Drawing Figures

DEVICE FOR DEPOSITING A LIQUID BINDER ON A FIBROUS SHEET FOR MANUFACTURING CIGARETTE FILTERS

The present invention relates to a device for applying on a sheet formed wholly or partly from synthetic or artificial short fibres, such as fibres of cellulose acetate, a liquid fibre-binding chemical agent, for example a specific plasticizer of the constituent material of the fibres, it being possible to produce the sheet by a conventional paper-making method or by the non-woven method and the sheet being intended for the production of cigarette filters.

Devices are already known for applying a binding agent to materials consisting of a large number of continuous cellulose acetate filaments which are in alignment and craped and form a flat band or ribbon termed "wick" for the purpose of their transformation into cigarette filters. In the course of this transformation, the wick of continuous filaments is first spread by suitable devices so as to achieve the separation of the filaments and feed it in the form of a wider sheet inside the device for applying the chosen binding agent. This device is mostly formed by a cabin in which the binding agent is sprayed in the form of a mist. This mist may be obtained by various methods known in the art, such as for example a centrifugal applicator, this device comprising a hollow wheel provided with small-diameter apertures on its periphery and rotating at high speed, the binding agent being distributed by means of a pump within the wheel and projected by centrifugal force through the apertures of the wheel and onto the endless sheet of filaments. In the various methods employed, the interior of the spraying cabin is provided with a number of deflectors having the following functions:

- maintain the endless sheet of filaments in a spread-out and flat form to ensure a uniform deposit of the binding agent;
- avoid projections of the binding agent outside the cabin;
- collect, without formation of drops which may fall back onto the sheet, the binding agent which is not retained on the endless sheet of filaments and thereby permit its recycling.

The use of these devices for applying a binding agent in the case of sheet materials consisting wholly or partly of synthetic or artificial short fibres such as cellulose acetate fibres, the sheet being obtained by a conventional paper-making method or by the non-woven method, has a number of drawbacks namely: as the sheet is spread out and unsupported inside the cabin, moving of the sheet occurs. Consequently, the sheet rubs against the walls of the inlet and outlet slots of the cabin and on the deflectors mounted inside the latter. This rubbing inevitably results in a more or less pronounced tearing away of the fibres impregnated with the binding agent, which is deposited on said rubbing parts and rather rapidly forms adhering zones which amplify the sheet fibre tearing phenomenon and result in a considerable braking of the sheet which might result in its rupture.

An object of the invention is to overcome these drawbacks and to avoid any movement of the material in the vicinity of zones liable to produce rubbing and consequently a tearing away of the fibres.

According to the invention, there is therefore provided a device for depositing a liquid agent for binding fibres together on a fibrous sheet constituted by artificial synthetic short fibres, such as cellulose acetate fibres, for producing cigarette filters, said sheet being produced by a paper-making method or by the non-woven method, the device comprising means for spraying the binding agent onto the fibrous sheet in the course of the travel of the sheet, wherein there is provided at least one movable support means with which one face of the fibrous sheet is in contact in the binding agent spraying zone, said spraying being carried out on the other face of the sheet.

According to one preferred embodiment, the movable means comprises a rotary support cylinder whose axis is perpendicular to the axis of the spraying of the binding agent, said cylinder being associated with two auxiliary cylinders located on each side of the support cylinder, the sheet being, in the course of its travel, in contact with the two auxiliary cylinders by one of its faces and with the support cylinder by its other face.

A device according to the invention is illustrated by way of a non-limitative embodiment in the accompanying Figures in which.

Figure 2:
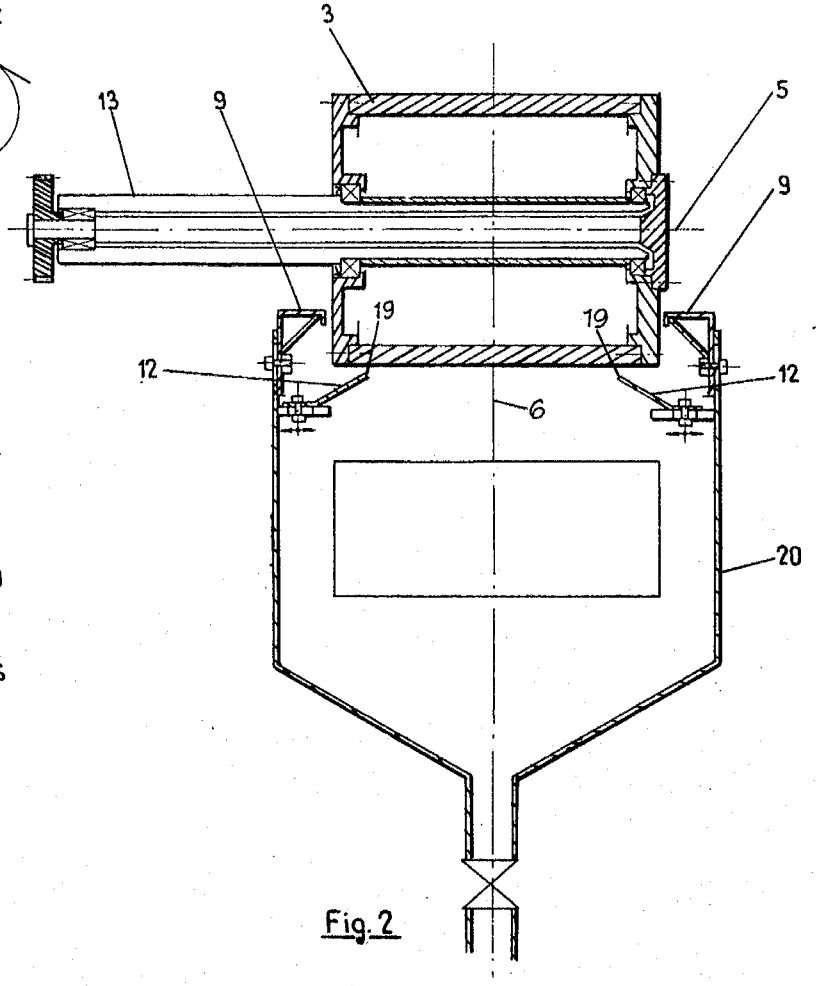
FIG. 2 is a sectional view taken on line AA of FIG. 1.
Figure 1:
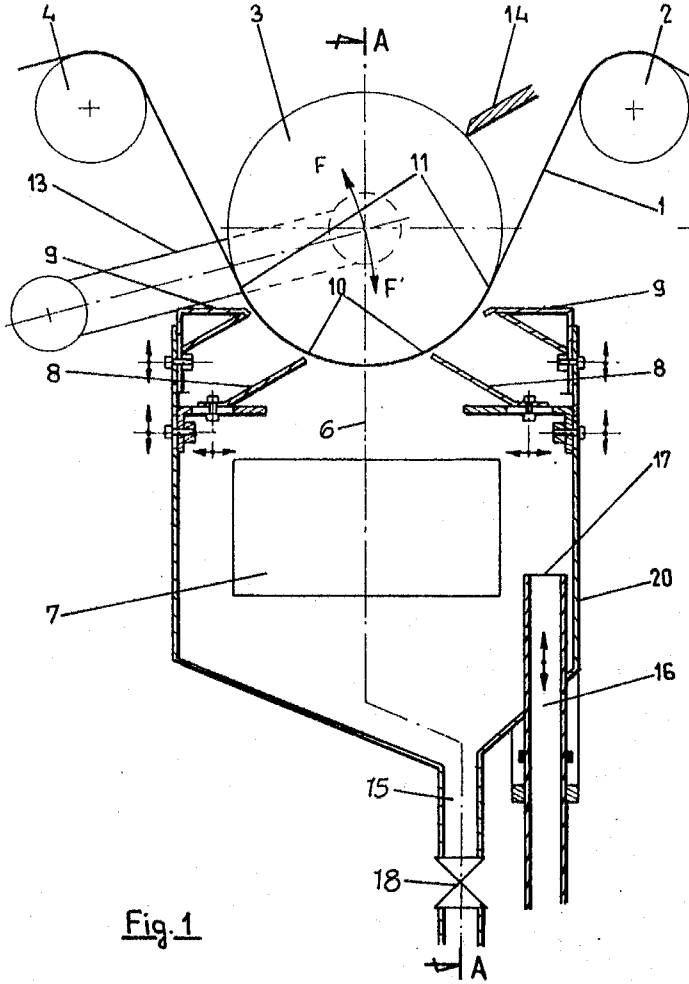
FIG. 1 is a diagrammatic sectional view of the spraying cabin with its device according to the invention.

Some secondary details have been omitted in the drawings in order to render the latter more clear.

In one manner of carrying out the invention, the fibrous sheet 1 passes round the rotary cylinders 2, 3 and 4 by contacting them on a certain arc in a path which constrains one of the faces of the sheet to contact the auxiliary cylinders 2 and 4 and the other face to contact the support cylinder 3. The result of this is to place the sheet 1 in the course of the application of the binding agent against the support cylinder 3 whose axis 5 is perpendicular to the axis 6 of the spraying of the mist of binding agent. This spraying can be achieved by means of a known device 7. Deflectors 8 are mounted inside the cabin 20 between the device 7 and the cylinder 3 so as to limit the spraying of binding agent to a portion 10 of the zone 11 of the sheet in contact with the support cylinder 3. These deflectors are adjustable in position so as to reduce to a minimum the distance between the deflectors and the sheet applied against the cylinder 3 and to limit the portion 10 of the zone 11 of the sheet on which the binding agent must be projected. A peripheral deflector 9 is mounted on the cabin 20 in order to ensure that no binding agent is projected out of the cabin, this deflector 9 being adjustable in position so as to reduce to a minimum the distance therebetween and the sheet held against the cylinder 3. Deflectors 12 are provided in order to permit limiting the width of the mist of the binding agent, these deflectors being adjustable in position so as to limit the portion 19 of the sheet in contact with the cylinder 3 on which the binding agent must be sprayed, this portion being at the most equal to the width of the sheet.

The cylinder 3 may be angularly displaced in the direction FF' by means of a pivotal lever 13 in order to facilitate the insertion of the sheet 1 in the spraying cabin.

A doctor 14 to which a to-and-fro movement is imparted is provided for continuously cleaning the surface of the cylinder 3.

An outlet 15 is provided at the lower most point of the spraying cabin for collecting excess binding agent and fibres which might have become detached from the sheet. The suspension is then filtered or directly returned to the supply circuit.

An outlet 16 may be used in the case where the spraying device 7 requires a constant level of binding agent 17 in the spraying cabin.

In this case, a flow rate limiter 18 is inserted in the outlet 15 so that there is a permanent flow through the outlet 16.

I claim:

1. A device for depositing a liquid agent for binding fibres on a fibrous sheet comprising artificial or synthetic short fibres, such as cellulose acetate fibres for producing cigarette filters, said sheet having been produced by a paper-making method or a non-woven method, said device comprising a rotary unperforated support cylinder associated with two auxiliary cylinders located on each side of a vertical plane containing the axis of rotation of the support cylinder, the sheet being in the course of the travel thereof in contact with the two auxiliary cylinders by one of its faces and with the support cylinder by its other face, spraying means disposed on the side of the sheet opposed to the rotary support cylinder and below the support cylinder for spraying the binding agent upwardly on the fibrous sheet as the fibrous sheet travels round the axis of the support roller, and deflecting means disposed on opposite sides of a vertical axis in said vertical plane and extending upwardly toward and terminating in close proximity to the support cylinder so as to mask parts of the support cylinder and expose only a desired area of the sheet which is in contact with the support cylinder to the binding agent coming from the spraying means.

2. A device as claimed in claim 1, wherein the deflecting means comprise two sets of substantially orthogonal adjustable deflectors.

3. A device as claimed in claim 1, comprising a further deflector which is adjustable in position for preventing projection of the binding agent outside the device, said further deflector being located very close to the part of the fibrous sheet which is in contact with the support cylinder.

4. A device as claimed in claim 1, wherein the support cylinder is provided with a cleaningdoctor.

5. A device as claimed in claim 1, wherein the support cylinder is mounted on a pivotal support to be angularly movable.

6. A machine for treating fibrous material in the form of a sheet for coupling to a cigarette filter producing machine, provided with a device for depositing a liquid agent for binding fibres on the fibrous sheet comprising artificial or synthetic short fibres, such as cellulose acetate fibres for producing cigarette filters, said sheet having been produced by a paper-making method or a non-woven method, said device comprising a rotary unperforated support cylinder associated with two auxiliary cylinders located on each side of a vertical plane containing the axis of rotation of the support cylinder, the sheet being in the course of the travel thereof in contact with the two auxiliary cylinders by one of its faces and with the support cylinder by its other face, spraying means disposed on the side of the sheet opposed to the rotary support cylinder and below the support cylinder for spraying the binding agent upwardly on the fibrous sheet as the fibrous sheet travels round the suppot roller, and deflecting means disposed on opposite sides of a vertical axis in said vertical plane and extending upwardly toward and terminating in close proximity to the support cylinder so as to mask parts of the support cylinder and expose only a desired area of the sheet which is in contact with the support cylinder to the binding agent coming from the spraying means.

* * * * *